US005498811A

United States Patent [19]

Perego et al.

[11] Patent Number: 5,498,811

[45] Date of Patent: Mar. 12, 1996

[54] PROCESS FOR PRODUCING GASOLINES AND JET FUEL FROM N-BUTANE

[75] Inventors: Carlo Perego, Carnate; Stefano Peratello, Nova Milanese, both of Italy

[73] Assignees: Eniricerche S.p.A., Milan; Enichem Synthesis S.p.A., Palermo, both of Italy

[21] Appl. No.: 224,873

[22] Filed: Apr. 8, 1994

[30] Foreign Application Priority Data

Apr. 8, 1993 [IT] Italy ..... MI93A0702

[51] Int. Cl.[6] ..... C07C 2/08; C07C 5/373

[52] U.S. Cl. ..... 585/324; 585/310; 585/329; 585/330; 585/332; 585/531; 585/533; 585/671

[58] Field of Search ..... 585/310, 324, 585/329, 330, 332, 520, 531, 533, 671

[56] References Cited

U.S. PATENT DOCUMENTS

| | | | |
|---|---|---|---|
| Re. 34,189 | 3/1993 | Harandi et al. | 585/312 |
| 5,275,995 | 1/1994 | Bellussi et al. | 502/207 |

FOREIGN PATENT DOCUMENTS

| | | |
|---|---|---|
| 0340868 | 8/1989 | European Pat. Off. . |
| 2186287 | 8/1987 | United Kingdom . |
| 2246524 | 2/1992 | United Kingdom . |

*Primary Examiner*—Ponnathapura Achutamurthy
*Attorney, Agent, or Firm*—Oblon, Spivak, McClelland, Maier & Neustadt

[57] ABSTRACT

Polymeric fuels are produced from saturated $C_4$ hydrocarbons by a process comprising:

(A) dehydroisomerizing a gas mixture comprising predominantly of n-butane and hydrogen in a catalytic reactor containing a catalyst (a) of platinum supported on alumina, whose surface is coated with silica, and, optionally, a solid acidic catalyst (b) selected from the group consisting of alumina, whose surface is coated with silica, and Boralite B, with an effluent being obtained which comprises a mixture of predominantly of unreacted n-butane, butenes and isobutene, all of which components of the mixture have a carbon atom content less than 5;

(B) separating the mixture of olefins and parafins from hydrogen and aromatic byproducts; and (C) oligomerizing said mixture in the presence of a catalyst consisting of amorphous silica-alumina gel, as determined by X-rays, having a silica:alumina molar ratio within the range of 30:1 to 500:1, with a surface area of from 500 to 1000 $m^2/g$, and a pore diameter substantially within the range of from 1 to 3 nm, thereby producing a gasoline material boiling within the range of 80° to 175° C., a jet fuel boiling within the range of 175°–300° C. and a gas oil boiling at temperatures greater than 300° C.

20 Claims, 3 Drawing Sheets

DISTILLATION CURVE
P = 15 bar, T = 50 C
WHSV = 2 (h -1)

% by weight
100
90
80
70
60
50
40
30
20
10
0
0
50
100
150
200
250
300
350
Temperature (C)
Conversion = 35%

DISTILLATION CURVE
P = 15 bar, T = 150 C
WHSV = 2 (h -1)

% by weight
100
90
80
70
60
50
40
30
20
10
0
0
50
100
150
200
250
300
350
400
Temperature (C)
Conversion = 60%

Conversion = 80%

Conversion = 100%

Conversion = 100%

Conversion = 100%

PROCESS FOR PRODUCING GASOLINES AND JET FUEL FROM N-BUTANE

BACKGROUND OF THE INVENTION

1. Field of the Invention

The present invention relates to a process for producing polymeric gasolines and jet fuel from saturated $C_4$ hydrocarbon fractions.

2. Description of the Background

The exploitation of $C_4$ fractions obtained as a byproduct from FCC (catalytic cracking on fluidized bed=fluid catalytic cracking) and steam cracking is becoming an increasingly serious problem in petroleum and petrochemical industries. In particular, interesting is the exploitation of the paraffinic fraction, and, mainly, of n-butane, remaining as a residue after the treatments for recovery and exploitation of olefins (e.g., separation of butadiene, esterification of isobutene and methyl-t-butyl-ether, oligomerization and alkylation of isobutane and n-butenes). In particular, in Italian Patent AppLication No. 21,157 A/90, n-butane is used in a process for obtaining isobutene-containing olefinic fractions, which constitutes a valuable intermediate which is useable in such chemical reactions as polymerizations and alkylations, and in isoprene production. The catalyst used for this transformation is based on platinum supported on alumina whose surface is coated with silica, possibly in mixture with a solid acidic catalyst selected from alumina surface coated with silica or Boralite B.

A process has now been found by which it is possible to use $C_4$ paraffinic fractions, essentially constituted by n-butane, as a starting material in conversion to valuable hydrocarbonaceous fractions suitable as engine fuels.

Several processes are known for preparing hydrocarbon fractions which are useful as fuels, by starting from light $C_3$–$C_4$ olefins in the presence of solid acidic catalysts.

In U.S. Pat. No. 3,960,978; EP-31,675 and U.S. Pat. No. 4,150,062 use is claimed of zeolites of the ZSM-5 type, in order to produce gasolines by olefin oligomerization. Unfortunately, the so obtained gasolines thus prepared also contain a fraction of aromatic hydrocarbons, mainly benzene. Such substances are obviously undesirable, because of their harmfulness to man.

In U.S. Pat. No. 4,227,992; U.S. Pat. No. 4,456,779 and U.S. Pat. No. 4,720,600, processes for light olefin oligomerization, catalyzed by zeolites of the ZSM-5 type, are disclosed, which make it possible to obtain products which contain a useful hydrocarbon fraction for use as jet and diesel fuel. However, these processes require that decidedly significantly high temperatures, i.e., of at least 250° C., are used.

At present, from an industrial viewpoint, the most widely used catalyst for producing polymeric gasoline is supported phosphoric acid (J. F. McMahon et al., "Polymerization Of Olefins As A Refinery Process", Adv Pet Chem., Volume VII, 1963, pages 285–321). This catalyst does not require as high reaction temperatures as those required by the processes with zeolite catalyst, but is affected by a number of other drawbacks: in fact, it is corrosive, when exhausted is not reclaimable, and disposing of it causes environmental problems. Furthermore, the polymeric fractions obtained are nearly exclusively light fractions, and jet and diesel fuels are not produced.

In Patent Application EP-340,868 amorphous silica and alumina gel, as shown by X-ray analysis, has a molar ratio of silica:alumina which is within the range of from 30:1 to 500:1, a surface area within the range of from 500 to 1000 $m^2/g$, and a pore diameter substantially within the range of from 1 to 3 nm. Such a catalyst can be advantageously used in the dimerization of linear $C_4$–$C_{15}$ olefins, in isobutene dimerization and propylene oligomerization.

Italian Patent Application 91 A 003 276, discloses the preparation of a silica-and-alumina-gel-based extruded catalyst which is very effective in propylene oligomerization.

SUMMARY OF THE INVENTION

Accordingly, one object of the present invention is to provide a process for producing both polymeric gasolines an jet fuel from saturated $C_4$ hydrocarbon fractions which does not display the drawbacks which affect the processes known from the prior art, such as, e.g., the formation of undesired aromatic byproducts, a too high process temperature, problems deriving from corrosivity and disposal of catalyst.

Briefly, the present invention is a process for producing gasolines, jet and diesel fuel which consists of:

(A) dehydroisomerizing a gas mixture comprising predominantly n-butane and hydrogen in a catalytic reactor containing catalyst (a) based on platinum supported on alumina whose surface is coated with silica and, optionally, a solid acidic catalyst (b) selected from alumina whose surface is treated with silica and Boralite B, with an effluent being obtained which contains a mixture of olefins and paraffins with a number of carbon atoms which is smaller than 5 and which is predominantly 4, (B) separating the mixture of olefins and paraffins from hydrogen and aromatic byproducts, and (C) oligomerizing the mixture of olefins and paraffins in the presence of a catalyst consisting of amorphous silica-alumina gel, as determined by X-ray analysis, with a molar ratio of silica:alumina comprised within the range of from 30:1 to 500:1, with a surface area of from 500 to 1000 $m^2/g$, with a pore diameter comprised within the range of from 1 to 3 nm, with gasolines, jet fuel and gas oil being obtained.

DETAILED DESCRIPTION OF THE PREFERRED EMBODIMENTS

Figure 1:
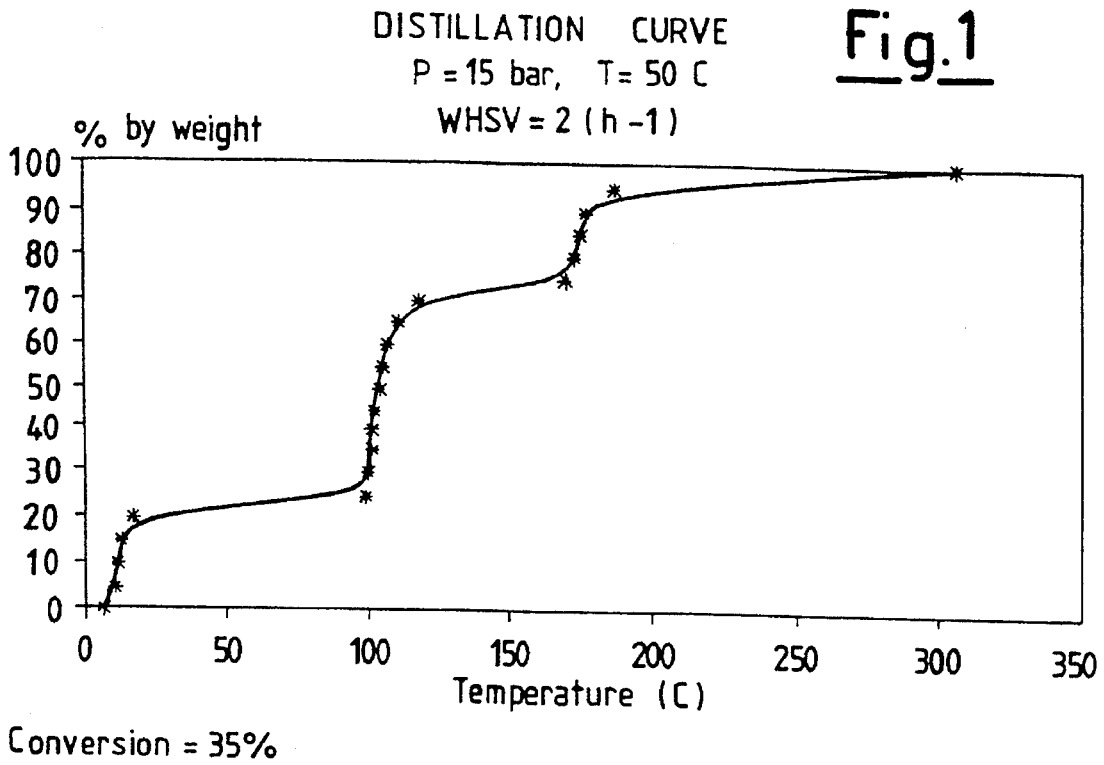
FIGS. 1–6 show the distillation curves of the oligomers prepared in accordance with Examples 7–12, respectively.

The preferred catalyst for (A) step of the process is formed of a solid carrier of porous γ-alumina on the surface of which catalytic amounts of platinum and silica are deposited. The alumina has a surface area of from 100 to 400 $m^2/g$ and a total pore volume comprised within the range of from 0.5 to 1.2 ml/g; on its surface, platinum is deposited in an amount comprised within the range of from 0.1 to 1% by weight and silica is deposited in an amount comprised within the range of from 0.5 to 5% by weight, preferably of from 1 to 2.5% by weight.

The catalyst (a) is disclosed in Italian Patent Application No. 21/157 A/90. According to a preferred embodiment thereof, to the catalyst (a) tin and/or indium are added as promoters. The amount of tin is comprised within the range of from 0.1 to 1% by weight, while the amount of indium is comprised within the range of from 0.05 to 1% by weight. Advantageously, the catalyst has a platinum:indium ratio of 0.3:1 to 1.5:1, preferably of 0.5:12.1.

Such a catalyst (a) can be suitably coupled with a second catalyst (b) which is Boralite B, or is a solid carrier of porous gamma-alumina, on the surface of which catalytic amounts of silica are deposited. The porous gamma-alumina used in the preparation of catalysts (a) and (b) can be in the form of granular particles, extruded bodies or pellets which are useful in a stationary catalytic bed.

Boralite B, as the catalyst (b), is disclosed in BE-877,205. It may be shaped as granular particles, extruded bodies or pellets of suitable size for use in a stationary catalytic bed. The weight ratio of catalyst (a) to catalyst (b) is within the range of from 20:80 to 80:20, preferably 70:30.

The (A) step of the process according to the present invention consists in feeding a gas mixture consisting substantially of n-butane and hydrogen, optionally diluted with an inert gas, such as, e.g., nitrogen, to a stationary-bed catalytic reactor.

In the gas feed stream, the molar ratio of hydrogen to n-butane is advantageously maintained within the range of from 1:1 to 5:1, and preferably of from 1:1 to 3:1. If the gas stream is diluted, e.g., with nitrogen, the molar ratios become: hydrogen:n-butane within the range of from 1:1 to 5:1, and nitrogen:n-butane within the range of from 1:1 to 5:1, preferably of from 1:1 to 3:1.

The (A) step is carried out at a temperature within the range of from 450° to 600° C., under a pressure of from 200 mm Hg up to 5 kg/cm$^2$ and with an hourly space velocity of from 0.5 to 5 h$^{-1}$ (weight of n-butane/weight of catalyst-hour). According to a different embodiment, the (A) step can be carried out by feeding a mixture of n-butane and isobutane in a molar ratio within the range of from 1:1 to 20:1, preferably of from 5:1 to 10:1.

When the catalyst(a) is used together with the catalyst (b), the catalysts are homogeneously distributed throughout the catalytic bed, or they are arranged as two adjacent layers.

In this second case, the layer of catalyst (a) will be so arranged in the reactor, as to be the first layer to come into contact with the gas feed stream. The catalytic bed will furthermore contain the catalysts (a) and (b) in mutual weight ratios of from 20:80 to 80:20, preferably on the order of 70:30.

The effluent streams leaving the reactor of the (A) step are cooled, in the (B) step, so as to separate a liquid stream constituted substantially of aromatic $C_6$+ hydrocarbons, from a gas stream which is compressed and cooled, so as to separate a liquid stream which is constituted of olefins and paraffins having a number of carbon atoms lower than 5 and substantially from a gas stream essentially consisting of hydrogen, and, possibly, nitrogen which is recycled to the initial step.

In the (C) step, the liquid stream of olefins and paraffins derived from the (B) separation step, is submitted to oligomerization. The olefins contained in this liquid stream essentially are isobutene, 1-butene, 2-butene. The oligomerization is carried out in a catalytic reactor containing an amorphous silica-alumina-gel-based catalyst as determined by X-ray analysis having a molar silica:alumina ratio within the range of from 30:1 to 500:1, a surface area of from 500 to 1000 m$^2$/g, and a diameter of the pores substantially within the range of from 1 to 3 nm.

The silica-alumina-gel-based catalyst can be used as such, or is bound by means of suitable metal oxides which dilute it and give it better mechanical properties. The catalyst can be used as granular particles or as extruded bodies with different geometrical shapes, preferably as small cylindrical bodies. The most suitable binders for such purposes are aluminas, silica, silica-aluminas and clays. The silica-alumina-gel and the binder can be mixed in amounts, by weight, ranging from 10:90 to 90:10, preferably from 30:70 to 80:20.

The oligomerization reaction is carried out continuously in a through-flow reactor with either a stationary or a fluidized bed, at a temperature within the range of from 50° to 300° C., under a pressure within the range of from 10 to 70 atm and with a WHSV (as referred to olefins only), within the range of from 0.2 to 4 h$^{-1}$.

When the oligomerization of light olefins derived from the (B) separation step is carried out in the presence of this silica-alumina-gel catalyst, preferably at a temperature within the range of from 120° to 250° C., a product is obtained which contains a gasoline fraction (with boiling temperature [b.t.] within the range of from 80° to 175° C.), jet fuel (b.t. 175°–300° C.) and gas oil (b.t.>300° C.), besides an LPG (liquified petroleum gas) fraction.

Such an oligomerization process does not lead to the formation of benzene and aromatics in general, differently from the same process using zeolites of the ZSM-5 type. As a consequence, under these process conditions according to which in step (B) the aromatic byproducts are separated from the mixture of $C_3$–$C_5$ olefins-paraffins, the oligomerization step (C) will lead to oligomeric products which are substantially free of aromatic hydrocarbons.

According to a different embodiment of the process according to the present invention, to the oligomerization reactors also those aromatic byproducts which are formed in the (A) step, can be sent to the oligomerization reactor. In this case, the fraction of oligomeric hydrocarbons will contain variable amounts of aromatics, however, not higher than 10%, expressed as benzene.

The effluent from the reactor of (C) step is separated into a liquid fraction and a gas fraction by means of usual processes, e.g., by flashing at a temperature of about 10°–50° C. A gas fraction is separated which is essentially constituted of $C_4$ hydrocarbons, which can be utilized as liquified petroleum gas (LPG), or can be recycled to the (A) step, in the presence of a low olefins content. The liquid fraction is submitted to fractional distillation, with a gasoline fraction, with a jet fuel fraction and a gas oil fraction being obtained.

In order to increase the jet fuel fraction, the gasolines can be partially or totally recycled to the oligomerization reactor. The gasoline fraction cam be used as such, or it can be hydrogenated in a separate process.

The jet fuel fraction can be hydrogenated in a separate process, in order to produce a paraffinic fraction meeting the required specifications.

The hydrotreatment can be carried out on the raw oligomeric product before distilling it.

If, in the (C) step, the liquid stream of olefins and paraffins derived from the (B) separation step is submitted to oligomerization at a temperature within the range of from 50° to 80° C. and under a pressure comprised within the range of from 10 to 16 atm, nearly exclusively isobutene can be oligomerized in order to practically yield only high-value gasolines (RON=102). Under such conditions, the consumption of 1-butene and 2-butene is very limited. By operating in that way, at the end of the process, after gasoline separation, 1-butene (polymer grade) can be isolated by fractionation, because the residual $C_4$ fraction contains only small amounts of isobutene. In fact, 1-butene and isobutene have very close boiling points (–6.3° and –6.9° C.), and their separation by distillation is very burdensome.

The following experimental examples are reported in order to illustrate the present invention in greater detail.

EXAMPLE 1

Preparation of the (a) Catalyst with Promoters

A commercial gamma-alumina is used which has a surface area of 196 $m^2/g$ and a total pore volume of 0.75 ml/g, as granular particles of 0.5–0.8 mm of size. An amount of 20 g of this gamma-alumina is charged to an autoclave together with 1.5 g of ethyl orthosilicate. The reaction mixture is kept standing for 2 hours, then the autoclave is evacuated in order to remove any unreacted ethyl orthosilicate excess, is flushed with nitrogen in order to exclude the presence of any oxygen, and is then pressurized with nitrogen at 5 $kg/cm^2$. The autoclave is heated up to 200° C. and is kept 4 hours at that temperature. At the end of this time period, the autoclave is cooled, the pressure is vented and the solid product is recovered and is submitted to a further heat treatment for 2 hours at 200° C. in nitrogen and calcination in air at 500° C. for 4 hours. Finally, the product is cooled and the solid material is recovered which consists of gamma-alumina containing, on its surface, a layer of silica, in an amount of 1.5% by weight.

To 20 g of this gamma-alumina, 30 ml of an aqueous solution obtained from 0.25 g of indium nitrate pentahydrate, 0.2 g of tin chloride, 0.47 g of chloroplatinic acid (containing 16% of platinum by weight) and 1.3 of 65% nitric acid, is slowly added with stirring. After a 1-hour contact at room temperature (about 25° C.) with continuous stirring, the reaction mass is heated 1 hour at about 120° C. under an air stream, in order to cause the excess of aqueous solvent to evaporate to a substantially complete extent. The resulting dry solid material is fired in a muff furnace at 500° C. over 4 hours under a flowing air stream. At the end of this time period, the muffle furnace is cooled and the catalyst (a), which contains 0.37% by weight of platinum, 0.50% by weight of tin and 0.36% by weight of indium, is recovered.

EXAMPLE 2

Preparation of (b) Boralite B Catalyst

In 28.12 g of an aqueous solution of tetraethylammonium hydroxide at 40% by weight, 3.0 g of NaOH and 6.4 g of boric acid are dissolved. A clear solution is obtained which is diluted with 30 g of distilled water and is added to 51 g of Ludox AS silica at 30% by weight of silica.

The so obtained suspension, having a pH value of 12.2, is kept 4 hours at room temperature with stirring and is then charged to the autoclave to crystallize under static conditions, under its autogenous pressure at 150° C., over 5 days.

The autoclave is then cooled and the milky suspension of seeds of Boralite B is recovered.

Such a suspension is added, in an amount of 15% by weight, to a mixture having the following composition, after that the latter was kept approximately 4 hours with stirring at room temperature:

112.5 g of TEA-OH at 40% in water
12.0 g of NaOH
25.5 g of $H_3BO_3$
120.0 g of distilled water
204 g of Ludox AS silica at 30% by weight.

Such a mixture with the seed suspension added is charged to a steel autoclave to crystallize under static conditions, under its autogenous pressure, at a temperature of 150° C. over 3 days.

The autoclave is cooled, Boralite B is recovered by filtration, is washed with distilled water, is dried at 120° C. and is fired 5 hours at 500° C., and then is exchanged into its acidic form, according to the methods known from the prior art. The resulting Boralite B, consisting of crystals of approximately 1 μm of size, is pelletized to yield pellets of from 0.4 to 0.8 mm.

EXAMPLE 3

Preparation of the Silica-alumina Gel Catalyst

An amount of 2 g of aluminum isopropoxide is dissolved at room temperature in 34 g of an aqueous solution at 30.6% of tetrapropylammonium hydroxide (TPA-OH). The resulting solution is diluted with 162 g of demineralized water, is heated to 60° C. and to it 104 g of tetraethyl silicate is added.

The resulting mixture has the following molar ratios:

$SiO_2/Al_2O_3=100$
TPA-OH/$SiO_2$=0.1
$H_2O/SiO_2=21$

This mixture is kept 30 minutes with stirring at 60° C. until a homogeneous gel is obtained which is dried under a flowing air stream at 90° C. and is then fired at 550° C.; firstly, under a flowing nitrogen stream, for 3 hours, and then 10 hours under a flowing air stream. 30 g of silica-alumina gel is obtained in a quantitative yield relative to the initially charged silicon and aluminum, which is pelletized into particles of 1–2 mm of size. The product displays the following characteristics:

molar ratio of $SiO_2/Al_2O_3=100:1$ surface area=800 $m_2/g$ (as measured by means of Carlo Erba's Sorptomatic 1800 apparatus)

porosity=0.44 ml/g, average pore diameter about 1 nm, absence of pores with greater diameter than 3 nm (values determined by Carlo Erba's Sorptomatic 1800).

EXAMPLE 4 [(A) Step]

0.78 g of (a) catalyst prepared according to Example 1 and 0.25 g of (b) catalyst prepared as disclosed in Example 2 are separately charged to a quartz reactor of 10 mm of inner diameter and are submitted to preliminary reduction under a flowing hydrogen stream, at 550° C. over 2 hours.

After the reduction, the dehydroisomerization test is carried out by feeding to the reactor a gas mixture containing hydrogen, n-butane and nitrogen with a molar ratio of hydrogen:n-butane of 1:1, and with a molar ratio of nitrogen:n-butane of 2:1. The reaction is furthermore carried out at 555° C., under atmospheric pressure and with an hourly space velocity, evaluated by referring to catalyst (a), of 2 (weight of n-butane/weight of catalyst-hour).

The results are shown in following Table 1.

TABLE 1

| | |
|---|---|
| Conversion (%) | 58.4 |
| Selectivity (%) | |
| isobutene | 25 |
| n-butenes | 39.9 |
| isobutane | 11.2 |

TABLE 1-continued

| Yield (%) | |
|---|---|
| $C_1$–$C_3$ | 6.8 |
| $C_5$+ | 2.8 |
| isobutene | 14.6 |
| n-butenes | 23.3 |
| aromatics | 4.4 |

EXAMPLE 5 [(A) Step]

0.56 g of catalyst (a) and 0.47 g of catalyst (b), both prepared as described in Examples 1 and 2 are separately charged to a quartz reactor of 10 mm inner diameter and are submitted to preliminary reduction under a flowing hydrogen stream, at 550° C. over 2 hours.

After the reduction, dehydroisomerization is carried out by feeding to the reactor a gas mixture containing n-butane and isobutane in a molar ratio of 5:1, with the same mixture being diluted with hydrogen in a molar ratio of 1:1 and nitrogen in a molar ratio of 1:3.

The reaction is carried out at 553° C., under atmospheric pressure and with a space velocity, evaluated by referring to the (a) catalyst, of 2 (weight of butanes/weight of catalyst-hour).

The conversion, computed relative to the moles of fed butanes, is 62%, with the following selectivity values:

isobutene 26.5% n-butenes 42.36%

EXAMPLE 6 [(B) Step]

The gas effluent obtained in Example 4 is cooled in a water cooler down to a temperature of 16°–17° C., and is sent to a gas-liquid separator, constituted by a water-cooled jacketed drum. The gases which leave the drum are compressed up to 5 abs. atm by means of a membrane compressor and are then sent to another, pressurized, gas-liquid separator (5 atm), also water-cooled (15°–17° C.). The gas fraction which separates is essentially composed of nitrogen and hydrogen.

The liquid fraction has the following composition:

| Name | % by weight |
|---|---|
| Propane | 0.89 |
| Propylene | 2.73 |
| n-butane | 44.73 |
| Isobutane | 8.41 |
| 1-butene | 10.61 |
| 2-cis-butene | 8.19 |
| 2-trans-butene | 9.12 |
| isobutene | 15.42 |

EXAMPLE 7 [(C) Step]

The liquid fraction from Example 6 is fed, by means of a piston pump, to an oligomerization reactor, constituted of a stationary-bed tubular reactor, to which 3 g of silica-alumina gel catalyst, prepared in accordance with Example 3 and having a granulometry comprised within the range of from 20 to 40 mesh, had been previously charged. The test run is carried out under the following operation conditions:

temperature: 50° C.

pressure: 15 bar

WHSV: 2 $h^{-1}$

Under such conditions, near only isobutene reacts. The total conversion, relative to all present olefins is 35%.

In FIG. 1, the distillation curve of the obtained product, as measured according to ASTM D-2887, is shown. The product is composed of isobutene dimers and trimers in a ratio of 3:1. The main constituent of the dimeric fraction is 2,4,4-trimethyl-1-pentene.

The product obtained as disclosed hereinabove is characterized by extremely good properties as gasolines (RON=102; MON=84).

EXAMPLE 8 [(C) Step]

The liquid fraction obtained after separation carried out in accordance with the process disclosed in Example 5, is fed to the oligomerization reactor, to which 3 g of silica-alumina gel catalyst prepared according to Example 2 (20–40 mesh) has been previously charged, under the following operating conditions:

temperature: 150° C.

pressure: 15 bar

WHSV: 2 $h^{-1}$ under such conditions, a total conversion, as computed relative to all present olefins, of 60%, was obtained.

Figure 2:
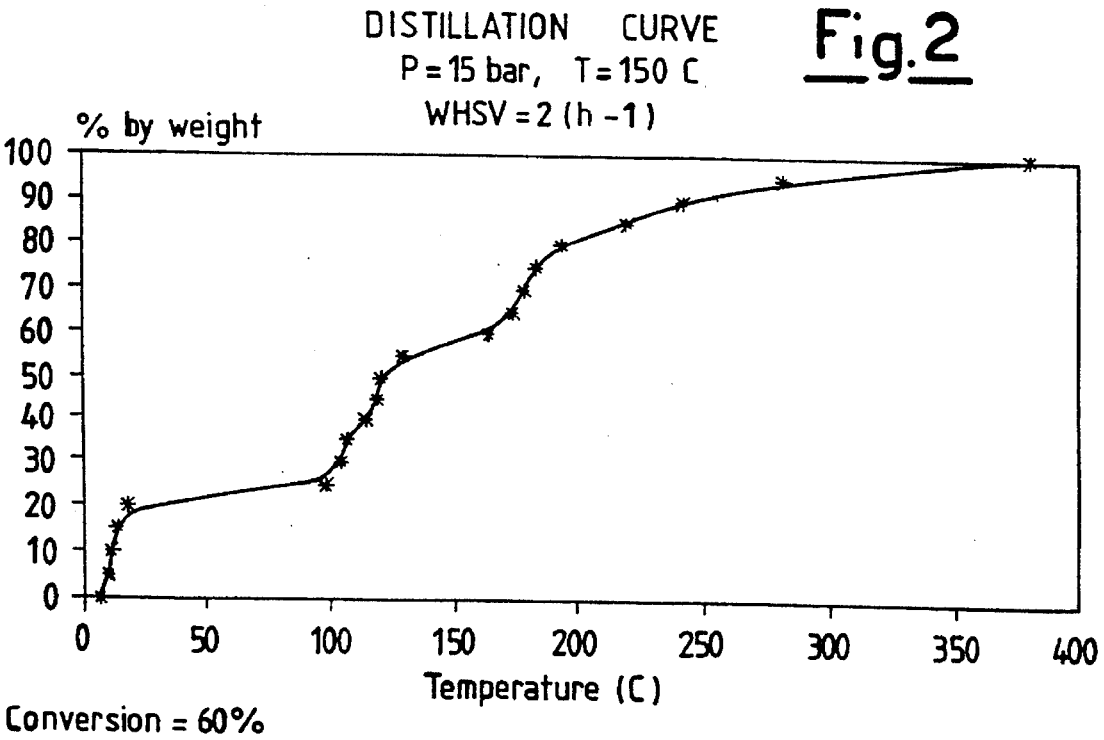

The distillation curve of the resulting oligomer is reported in FIG. 2.

EXAMPLE 9 [(C) Steo]

The liquid fraction obtained after separation carried out in accordance with the process disclosed in Example 5, is fed to the oligomerization reactor to which 3 g of catalyst (20–40 mesh) had been previously charged, under the following operating conditions:

temperature: 200° C.

pressure: 15 bar

WHSV: 2 $h^{-1}$

Under such conditions, a total conversion, as computed relative to all present olefins, of 80%, was obtained.

Figure 3:
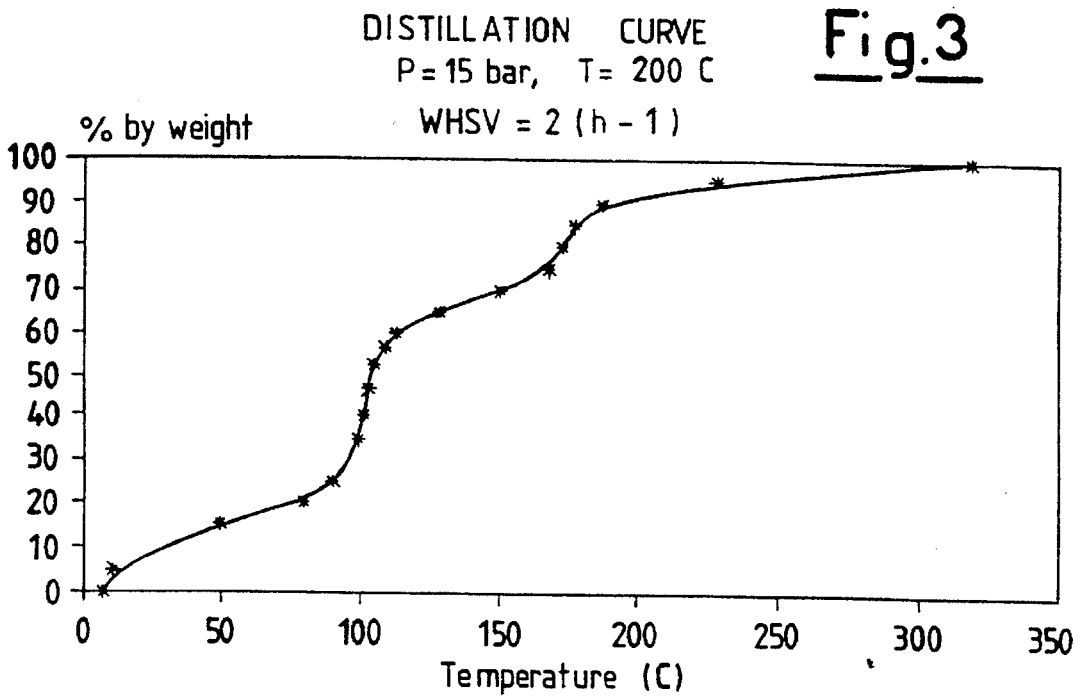

The distillation curve of the resulting oligomer is shown in FIG. 3.

EXAMPLE 10 [(C) Step]

The liquid fraction obtained after separation is carried out in accordance with the process disclosed in Example 5, is fed to the oligomerization reactor, to which 3 g of catalyst (20–40 mesh) had been previously charged, under the following operating conditions:

temperature: 130° C.

pressure: 30 bar

WHSV: 2 $h^{-1}$

Under such conditions, a total conversion, as computed relative to all present olefins, of 100%, was obtained.

Figure 4:
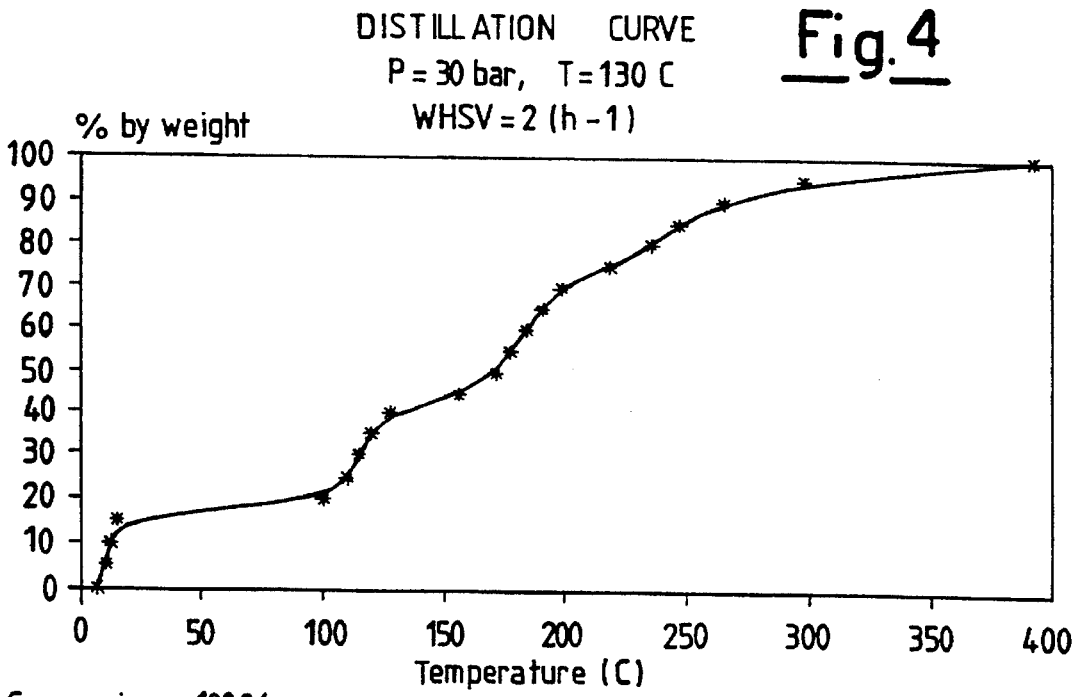

The distillation curve of the resulting oligomer is shown in FIG. 4.

EXAMPLE 11 [(C) Step]

The liquid fraction obtained after separation carried out in accordance with the process disclosed in Example 5, is fed to the oligomerization reactor, to which 3 g of catalyst (20–40 mesh) had been previously charged, under the following operating conditions:

temperature: 150° C.

pressure: 30 bar

WHSV: 2 $h^{-1}$

Under such conditions, a total conversion, as computed relative to all present olefins, of 100%, was obtained.

Figure 5:
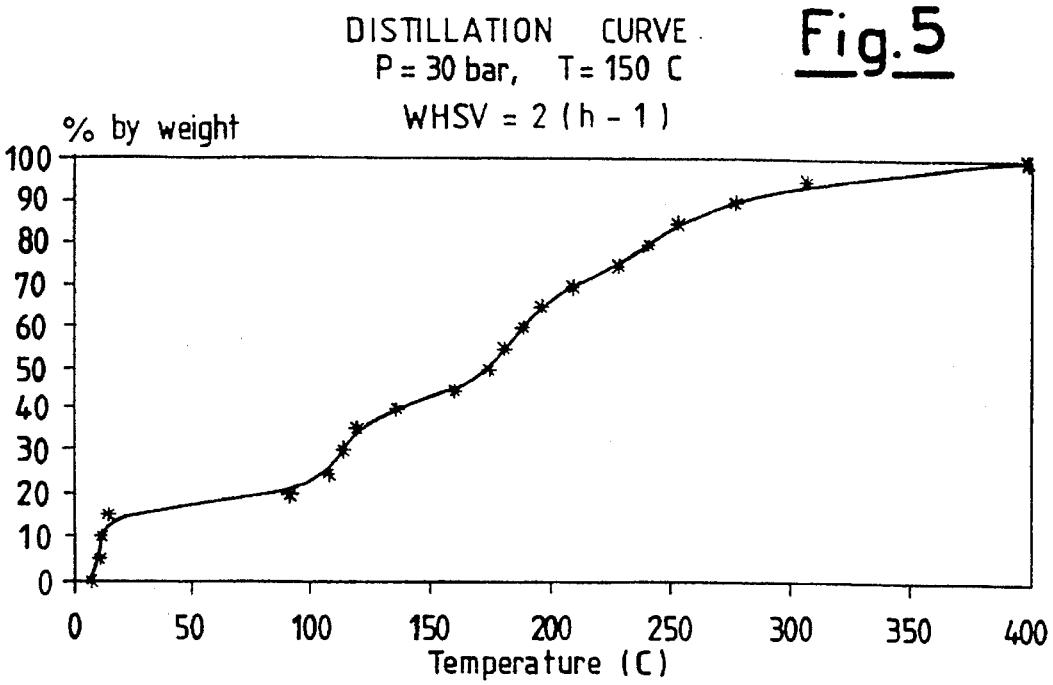

The distillation curve of the resulting oligomer is shown in FIG. 5.

EXAMPLE 12 [(C) Step]

The liquid fraction obtained after separation carried out in accordance with the process disclosed in Example 5, is fed to the oligomerization reactor, to which 3 g of silica-alumina gel catalyst (20–40 mesh) had been previously added, under the following operating conditions:

temperature: 200° C.

pressure: 30 bar

WHSV: 2 $h^{-1}$.

Under such conditions, a total conversion, as computed relative to all present olefins, of 100%, was obtained.

Figure 6:
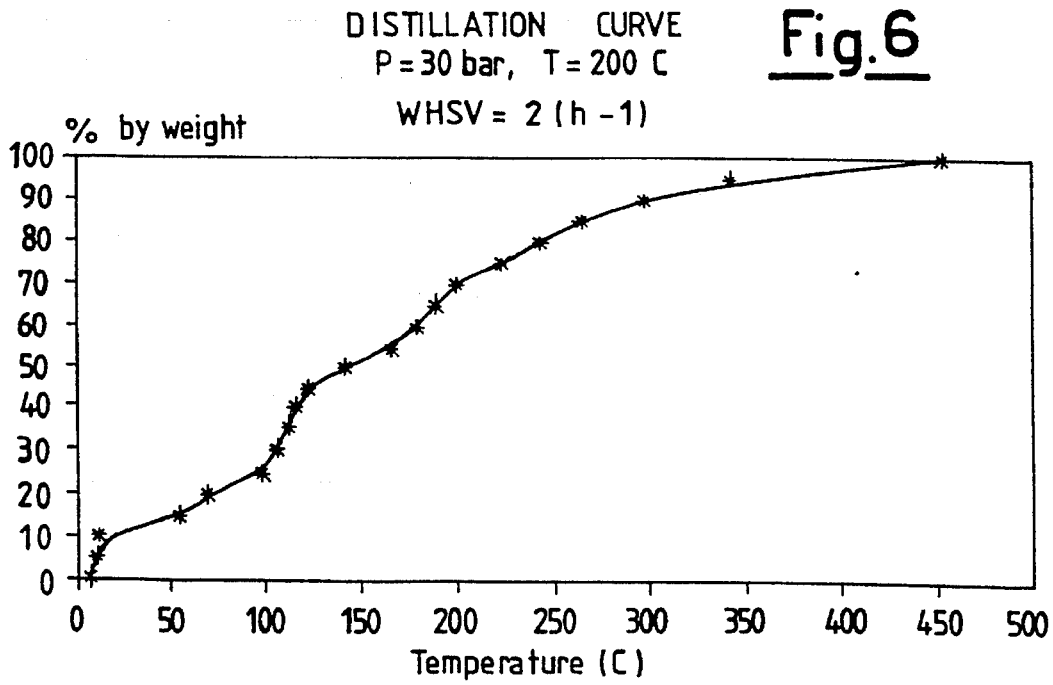

The distillation curve of the resulting oligomer is shown in FIG. 6.

EXAMPLE 13

The oligomer obtained from the test reported in Example II was separated by distillation into two cuts boiling at 60°–175° C. and 175°–300° C., respectively, corresponding to gasoline and jet fuel cuts, respectively.

Engine tests carried out on such cuts yielded the following results:

| | Gasolines |
|---|---|
| RON | 98 |
| MON | 84 |
| Olefins | 99% by weight |
| Saturated hydrocarbons | 1% by weight |
| Aromatics | 0% by weight |
| | Jet fuel |
| Freezing point | <–60° C. (*) |
| Smoke point | 38 mm (*) |

(*) Value measured after hydrogenation.

EXAMPLE 14

The gas effluent obtained from the test run disclosed in Example 4, is compressed up to 5 abs. atm by means of a membrane compressor and then is sent to a water-cooled (15°–17° C.), pressurized gas-liquid separator (5 atm). The gas fraction which separates is essentially composed of nitrogen and hydrogen.

The liquid fraction has the following composition:

| Name | Percent by weight |
|---|---|
| Propane | 0.81 |
| Propylene | 2.47 |
| n-Butane | 40.55 |
| Isobutane | 7.62 |
| 1-Butene | 9.62 |
| 2-cis-Butene | 7.42 |
| 2-trans-Butene | 8.26 |
| isobutene | 13.98 |
| $C_5$+ | 3.35 |
| Aromatics | 5.89 |

Such a liquid fraction is fed, by means of a piston pump, to an oligomerization reactor, which is constituted by a stationary-bed tubular reactor, previously charged with 3 g of silica-alumina gel catalyst, prepared in accordance with Example 3 and having a granulometry within the range of from 20 to 40 mesh. The test run is carried out under the following operation conditions:

temperature: 130° C.

pressure: 30 bar

WHSV: 2 $h^{-1}$

Under such conditions, a total conversion rate, as computed relative to all present olefins, of 100%, was obtained.

The content of aromatics in the oligomer, as determined by proton NMR spectroscopy, was 10%, computed as benzene.

We claim:

1. A method of producing polymeric fuels from saturated $C_4$ hydrocarbons, comprising:

(A) dehydroisomerizing a gas mixture comprising predominantly n-butane and hydrogen in a catalytic reactor containing a catalyst (a) comprising alumina, on the surface of which platinum is deposited in an amount within the range of from 0.1 to 1% by wt. and silica deposited thereon in an amount within the range of from 0.5 to 5% by wt. and, optionally, a solid acidic catalyst (b) selected from the group consisting of alumina, whose surface is coated with silica, and Boralite B, with an effluent being obtained which comprises a mixture of olefins and paraffins predominantly containing unreacted n-butane, butenes and isobutene, all of which components of the mixture have a carbon atom content less than 5;

(B) separating the mixture of olefins and paraffins from hydrogen and aromatic byproducts; and (C) oligomerizing said mixture in the presence of a catalyst consisting of silica-alumina gel, amorphous as determined by X-rays, having a silica:alumina molar ratio within the range of 30:1 to 500:1, with a surface area of from 500 to 1000 $m^2/g$, and a pore diameter substantially within the range of from 1 to 3 nm, thereby producing a gasoline fraction boiling within the range of 80° to 175° C., a jet fuel boiling within the range of 175°–300° C. and a gas oil boiling at temperatures greater than 300° C.

2. The method of claim 1, wherein the catalyst (a) consists of a solid carrier of a porous γ-alumina having a surface area of from 100 to 400 $m^2/g$ and a total pore volume within the range of 0.5 to 1.5 ml/g, on the surface of which platinum is deposited in an amount within the range of from 0.1 to 1% by wt. and silica deposited thereon in an amount within the range of from 0.5 to 5% by wt.

3. The method of claim 2, wherein the amount of deposited silica ranges from 1 to 2.5% by wt.

4. The method of claim 1, wherein the catalyst (A) further comprises tin in an amount of from 0.1 to 1% by wt., indium in an amount of from 0.05 to 1% by wt., or a combination thereof, at a platinum:indium ratio ranging from 0.3:1 to 1.5:1 and a platinum:tin ratio ranging from 0.5:1 to 2:1.

5. The method of claim 1, wherein the ratio, by weight, of catalyst (a) to catalyst (b) is within the range of 20:80 to 80:20.

6. The method of claim 5, wherein said weight ratio is 70:30.

7. The method of claim 1, wherein, in step (A), the molar ratio of hydrogen to n-butane in the gas feed mixture is maintained within the range of 1:1 to 5:1.

8. The method of claim 7, wherein said hydrogen to n-butane ratio ranges from 1:1 to 3:1.

9. The method of claim 7, wherein the gas mixture of n-butane and hydrogen is diluted with nitrogen such that the diluted mixture has a nitrogen:n-butane molar ratio of 1:1 to 5:1.

10. The method of claim 9, wherein said nitrogen: n-butane ratio is 1:1 to 3:1.

11. The method of claim 7, wherein the gas feed mixture comprises isobutane which is present in an amount such that the molar ratio of isobutane to n-butane ranges from 1:1 to 1:20.

12. The method of claim 11, wherein said molar isobutane:n-butane ratio ranges from 1:5 to 1:10.

13. The method of claim 1, wherein step (A) is conducted at a temperature within the range of 450° to 600° C. under a pressure of 200 mm Hg up to 5 kg/cm$^2$, and with an hourly space velocity within the range of 0.5 to 5 h$^{-1}$ (weight of n-butane/weight of catalyst-hour).

14. The method of claim 1, wherein the separation of step (B) is conducted by:

(1) cooling the effluent obtained from step (A) in order to separate a liquid stream primarily comprising aromatic hydrocarbons from a gas stream, and (2) subjecting the gas stream obtained to compression and cooling in order to separate a liquid stream constituted of olefins and paraffins having a carbon atom content of less than 5 from a gas stream substantially comprising hydrogen, which is recycled to step (A).

15. The method of claim 1, wherein, in step (C) the silica-alumina gel is bound with metal oxide binders selected from the group consisting of silica, alumina, silica-alumina, titanium oxide, magnesium oxide, zirconium oxide and clays.

16. The method of claim 15, wherein the silica-alumina gel and the metal oxide are mixed together in a weight ratio within the range of from 10:90 to 90:10.

17. The method of claim 16, wherein the weight ratio of silica-alumina gel to metal oxide ranges from 30:70 to 80:20.

18. The method of claim 1, wherein step (C) is conducted at a temperature within the range of from 50° to 300° C. under a pressure within the range of 10 to 70 atm and at a weight hourly space velocity (WHSV) of olefins within the range of from 0.2 to 4 h$^{-1}$.

19. The method of claim 18, wherein the temperature in step (C) ranges from 120° to 250° C.

20. The method of claim 18, wherein the temperature of step (C) ranges from 50° to 80° C., the pressure is within the range of from 10 to 16 atm and the product obtained is substantially said gasoline fraction.

* * * * *